United States Patent [19]

Rosenberg

[11] Patent Number: 4,602,165

[45] Date of Patent: Jul. 22, 1986

[54] SWITCH ASSEMBLY FOR MAINTAINING AN ELECTRIC TIME SWITCH CLOCK SYNCHRONIZED WITH REAL TIME

[76] Inventor: Richard W. Rosenberg, Cinebar, Wash. 98533

[21] Appl. No.: 704,959

[22] Filed: Feb. 25, 1985

[51] Int. Cl.[4] ..... H01H 43/00

[52] U.S. Cl. ..... 307/141; 307/141.4; 307/142; 361/96; 368/204

[58] Field of Search ..... 307/141, 597, 142, 598, 307/143, 480; 361/22, 33, 157, 160, 195, 196, 202, 139, 75, 73, 83, 89, 94, 96, 97; 368/64, 66, 203, 204

[56] References Cited

U.S. PATENT DOCUMENTS

| | | | |
|---|---|---|---|
| 3,721,832 | 3/1973 | Lee | 307/141 |
| 3,902,311 | 9/1975 | Chacon et al. | 368/64 |
| 4,062,007 | 12/1977 | Scott | 307/141 X |
| 4,099,372 | 7/1978 | Beyers | 368/64 X |
| 4,277,693 | 7/1981 | Hoekman | 307/141 |
| 4,365,167 | 12/1982 | Weimer | 307/66 |
| 4,415,943 | 11/1983 | Wortman | 361/22 |
| 4,426,639 | 1/1984 | Jessup | 307/141 X |
| 4,540,984 | 9/1985 | Waldman | 307/141 X |
| 4,557,606 | 12/1985 | Meisner et al. | 368/203 X |

FOREIGN PATENT DOCUMENTS

| | | | |
|---|---|---|---|
| 0045589 | 3/1983 | Japan | 368/203 |

*Primary Examiner*—Bernard Roskoski
*Assistant Examiner*—Shik Luen Paul Ip
*Attorney, Agent, or Firm*—Eugene D. Farley

[57] ABSTRACT

An automatic electric switch assembly with associated timers re-synchronizes a time clock with real time after a power interruption.

1 Claim, 3 Drawing Figures

SWITCH ASSEMBLY FOR MAINTAINING AN ELECTRIC TIME SWITCH CLOCK SYNCHRONIZED WITH REAL TIME

BACKGROUND AND GENERAL STATEMENT OF THE INVENTION

This invention relates to an automatic electric switch assembly with associated timers for re-synchronizing a time clock with real time after a power interruption.

Electric power companies are searching for methods to reduce their peak demands. Special rates and demand charges have been devised to encourage large commercial and industrial accounts to reduce their demand during peak periods. However, the bulk of the load (the residential customer) represents a special problem.

Each individual customer returns a very small amount of money to the utility. Any plan to encourage the residential customer to reduce peak demand must have a low first cost to make a reasonable return on the investment. Such concepts as demand metering are very unpopular as they represent an additional cost to the customer.

The only practical means available to power companies for reducing residential demand is to "turn off" the water heater during peak periods. The water heater is an energy storage device that can supply hot water after being "turned off".

Controlling a residential water heater during peak periods will reduce the peak demand per residence a minimum of 1 KW. This reduction would return a power company $5.70/month, for example, in the winter and $2.48/month in the summer, based on the wholesale power rate charged utilities by a typical power company.

1984 Bonneville (Oregon) Power Administration (B.P.A.) Rate Schedule

| SEASON | CONSUMPTION CHARGE | DEMAND CHARGE |
|---|---|---|
| WINTER | 1.67./KWH | $5.70/KW |
| SUMMER | 1.34./KWH | $2.48/KW |

Devices are on the market to turn off water heaters during peak periods. However, their initial cost discourages their purchase. The most common form is a watt-hour meter with a built in time clock that operates a power relay at the water heater. The cost of the meter is $150 and the relay is $30. The installation cost is $75.

The cheapest means of controlling a water heater is through the standard (interval) timer employing mechanical trippers and a synchronous (clock) motor. However it cannot maintain correct time continuously due to power outages. This problem makes the standard interval timer almost useless to utilities.

The present invention overcomes this objection and makes the use of the timer feasible for utilities. The first cost of a timer with this enhancement is estimated at $28–$34. Installation cost is $20. The timer thus would pay back its initial investment in one year.

It accordingly is the general object of this invention to provide a simple and economical means to automatically "reset" or synchronize a time clock after one or more power outages.

Another object of this invention is to provide a compact synchronizing device which can be placed inside the cabinet of most time clocks.

A further object of this invention is to provide an electric time clock synchronizing device having very low power requirements and consequently requiring a very small battery as a power source.

These and other objects of the invention are achieved by the provision of an automatic electric time delay switch assembly for maintaining a time switch clock synchronized with real time in the event of an electric power failure which comprises an electric circuit including a power source and a time switch clock.

First electronic time delay means in the electric circuit is operative to measure a first predetermined period of time after the occurrence of a power failure. Electric relay means in the electric circuit is operative in the open condition to disconnect the clock from the power source if the power failure remains at the conclusion of the said first predetermined time period.

Second electronic time delay means in the electric circuit is operative upon disconnection of the clock from the power source to maintain the relay means in its open condition for a second predetermined period of time which corresponds to a complete cycle of the clock. The second electronic time delay means then is further operative to re-connect the clock to the power source in synchronization with real time at the conclusion of the second predetermined period of time if, during that period, power has been restored to the circuit.

DETAILED DESCRIPTION OF PREFERRED EMBODIMENTS OF THE INVENTION

Figure 3:
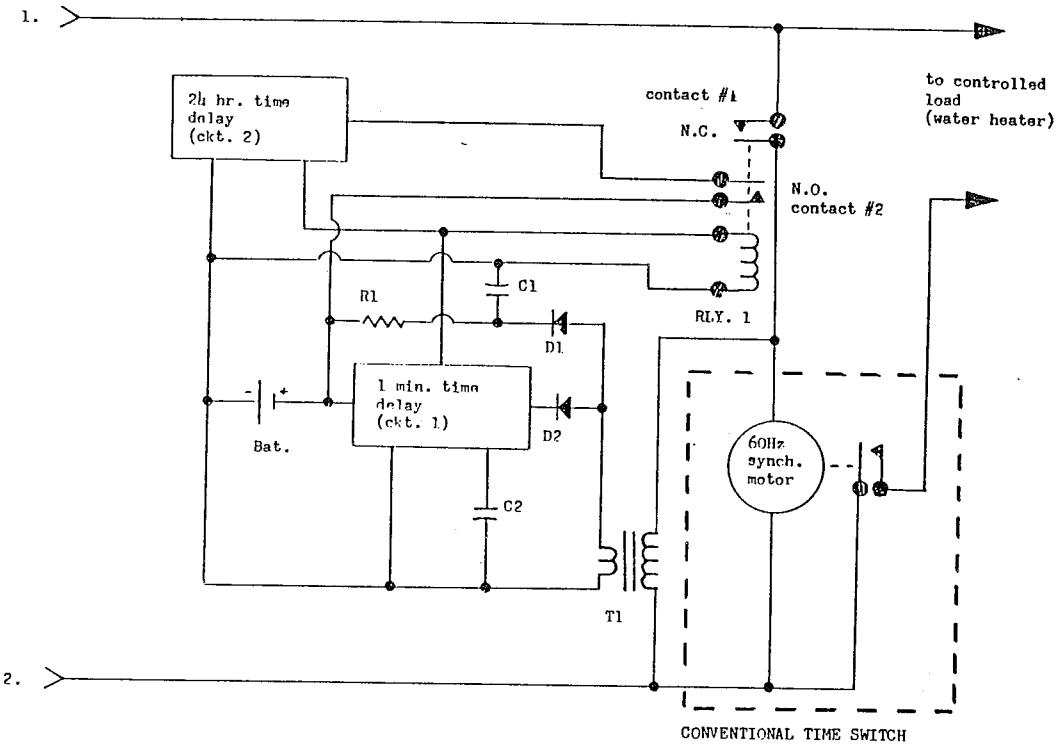
FIG. 3 is a circuit diagram of the invention in another of its embodiments.

In the embodiment of FIG. 3, the circuit components are as follows:

Conventional Time Switch:

This is a time switch with a 120 V, 208 V, 240 V, 277 V or 480 V synchronous motor. The time dial may be 24 hr. or 12 hr. The contacts are operated by mechanical "trippers" fastened to the dial. The switch may operate loads of the above listed voltages.

T1:

This is a 120 V, 208 V, 240 V, 277 V or 480 V primary to low voltage (4–18 V) secondary transformer. Its purpose is to provide low voltage A-C current to charge the battery and to latch relay RLY 1 when required.

D1:

This is a diode to rectify alternating current to direct current to charge the battery.

R1:

This is a resistor to limit current flowing into the battery. It is also used to help filter out A-C ripple in conjunction with C1.

D2:

This diode allows current to flow into and activate time delay ckt. #1. It also allows C2 to be charged, but not discharged, through T1.

C1:

This is a filtering capacitor to minimize A-C ripple to the battery.

C2:

This is a capacitor that stores energy necessary for time delay #1. The value of this capacitor determines the amount of time delay.

Time Delay #1:

This is a time delay designed to maintain sufficient current flow through the coil of RLY 1 to keep contacts #1 closed and contacts #2 open during the period of the delay.

Time Delay #2:

This is a time delay which after being activated will send a pulse at the end of its period which will cause RLY 1 to close contacts #1 and open contacts #2. The period of this delay would be 24 hrs. for a 24 hr. dial or 12 hrs. for a 12 hr. dial.

RLY 1:

This is a double pole, double throw relay with a low voltage D.C. coil.

BAT:

This is a rechargeable nickel cadmium battery.

Electric time switches consisting of a synchronous motor driving a time dial with the associated trippers cannot maintain a synchronism with real time during a power outage. The electronic circuit of FIG. 3, above described, is designed to keep the time switch in synchronism with real time by turning the time switch motor "on" or "off" by operation of relay RLY 1. The basic principle of operation of the circuit is as follows:

1. Consider the time switch in synchronism with real time.

2. A power outage occurs.

3. A one minute time delay (CKT. 1) starts a one minute timing function which maintains RLY 1. coil energized. Contacts #1 remained closed and contacts #2 remain open.

4. If power is restored within the one minute interval, the time switch motor starts again in virtual synchronism with real time, the error being equal to the duration of the outage.

5. If the power outage is of greater duration than one minute, then time delay ckt. 1 de-energizes the coil of RLY 1. This allows contact #1 to open and contact #2 to close. Contact #2 energizes a 24 hour time delay (time delay ckt. #2). During this 24 hour period contact #1 stays open thus preventing the synchronous motor from running even if power were restored during the period. 6. At the end of the 24 hour period, time delay circuit #2 sends a pulse to the coil of RLY 1. This pulse closes contact #1 and opens contact #2. If power has been restored to terminals #1 and #2, then relay RLY 1. will "latch" due to current flowing from terminals #1 and #2 through transformer T1, diode D2, and time delay ckt. #1.

7. If power has not been restored to terminals #1 and #2, then at the end of the 24 hr. delay period, time delay ckt #2 will send a pulse to the coil of RLY 1. causing contacts #1 to momentarily close and contact #2 to momentarily open. Latching of RLY 1. will not occur since current is not available to flow from terminals #1 and #2. As contacts #2 close, time delay ckt. #2 starts another 24 hour time period.

It is noted further that time delay #1 can have a period of from a fraction of a second to several minutes depending on the situation. The purpose of time delay #1 is to prevent going into the 24 hr. time delay when the power outage is of a momentary nature.

The same principle of operation can be applied to a 12 hour time switch with a 12 hour dial if the time delay ckt #2 is changed to a 12 hour delay.

The basic principle of operation is for the electronic circuit to make the time switch abort a complete timing cycle should a power outage occur. When the power is recycle stored, the electronics allows the time switch to start up again in synchronism with real time.

Figure 1:
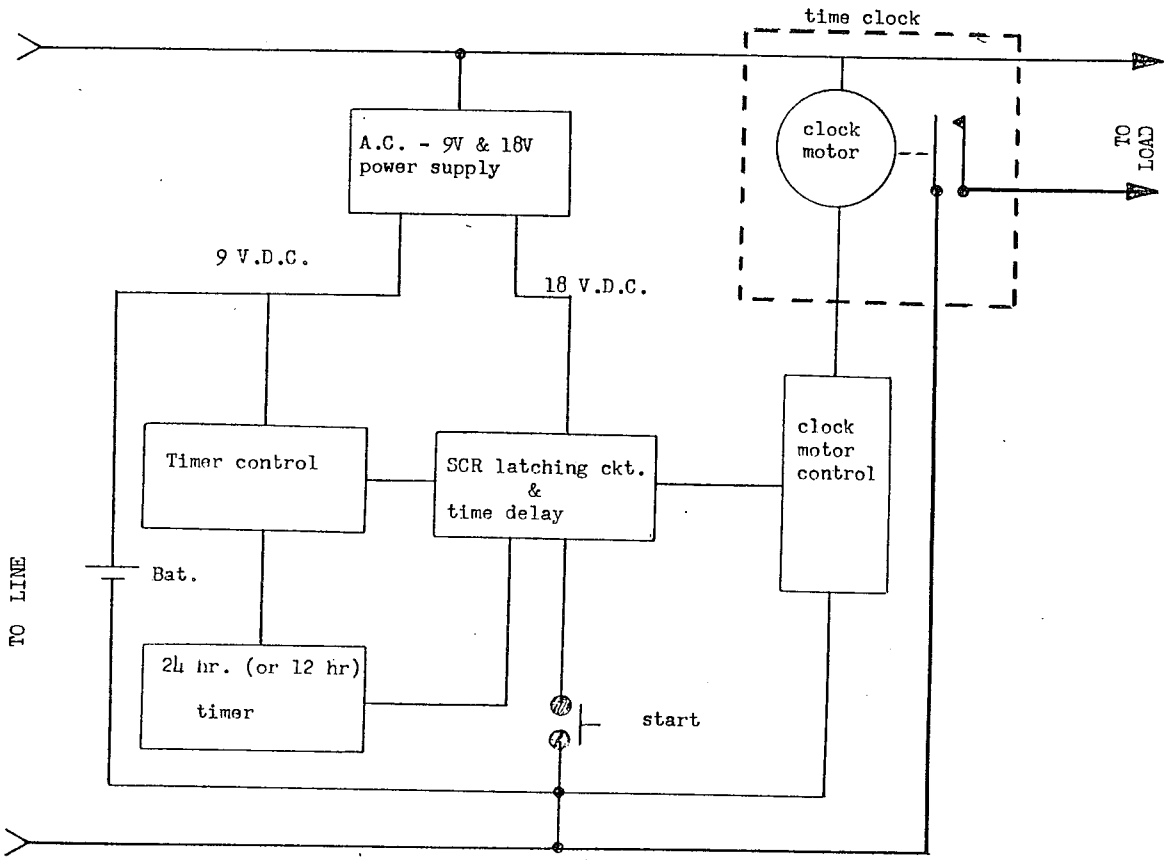
FIG. 1 shows a block diagram of a first embodiment of the power timing and switch circuits of the invention incorporating solid state controls.
Figure 2:
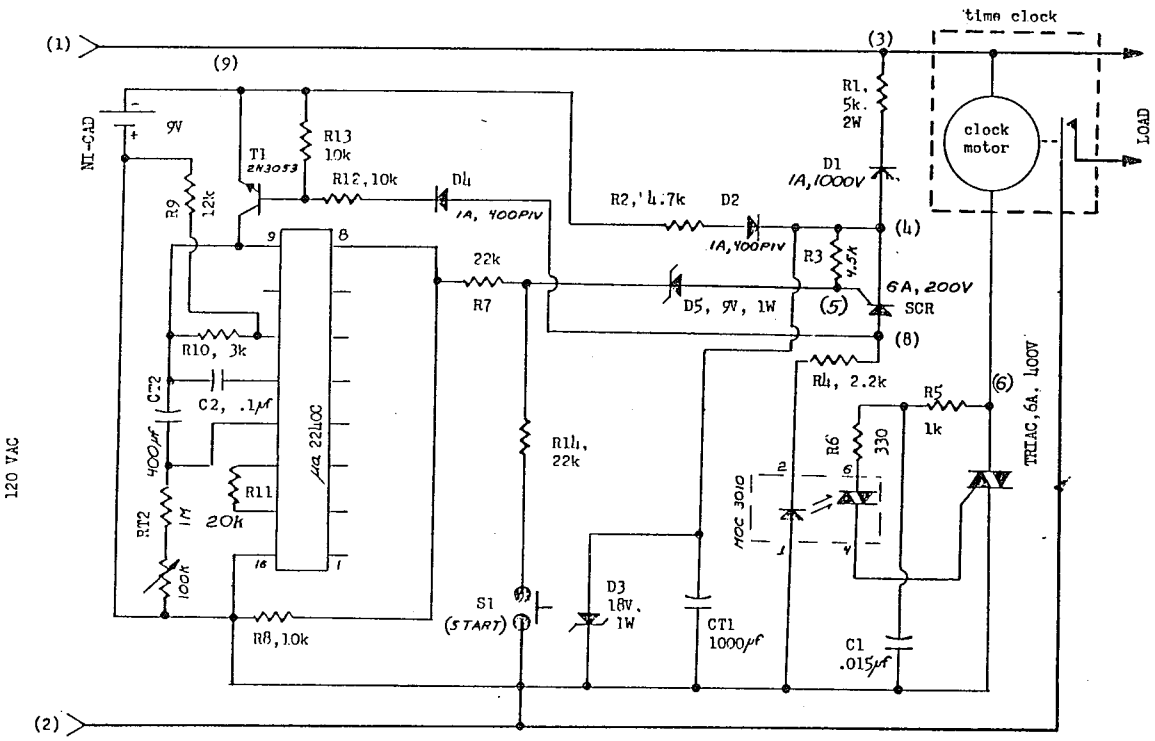
FIG. 2 is a detailed circuit diagram of the embodiment of the invention shown in FIG. 1.

FIGS. 1 and 2 illustrate a solid state embodiment wherein A.C. power is supplied at terminals 1 and 2. The embodiments enclosed by heavy dashed lines are the device (time clock) which the invention operates.

A.C. power enters resistor R1 at (3) which reduces the voltage to be rectified by diode D1. Zener diode D3 maintains the rectified voltage at (4) at 18 V.

During normal operation SCR is in the "on" state and is latched on (no signal is necessary at the SCR gate (5) to maintain the SCR in an on state.)

With SCR "on" current flows through resistor R4 and a light emitting diode of optocoupler MOC 3010.

Optocoupler MOC 3010 consists of a light emitting diode which directs light on a light sensitive silicon bilateral switch. The current flowing through the light emitting diode will cause the silicon bilateral switch to conduct.

A.C. current flows through resistors R5 and R6 to the gate of the triac. The A.C. current causes the triac to conduct from terminal (6) to (7). This A.C. current flow causes the clock motor to operate. Capacitor C1 compensates trigger pulses to the triac for lagging power factor loads.

For small motor loads, the optocoupler can be used to energize the clock motor directly, eliminating the triac, resistors R5, R6 and capacitor C1. (Connect terminal 6 of MOC 3010 to (6) and terminal 4 of MOC 3010 to (7).

During normal operation, current flows from (4) through diode D2 and resistor R2 to the negative terminal of the nickel-cadmium battery thus maintaining the battery in a charged state. Diode D2 prevents the battery from being discharged during a power interruption by stopping current flow through the SCR from the battery.

During normal operation, the voltage at (8) is negative with respect to (9) thus maintaining transistor T1 in a nonconducting state.

Transistor T1 when non-conducting prevents voltage to the integrated circuit timer Ua 2240C thus preventing it from operating.

During normal operation, capacitor CT1 is in a charged state.

During a power interruption at terminals (1) and (2) current will flow from CT1 through SCR, R4 and the light emitting diode of MOC 3010 until the minimum holding current of the SCR is reached. At that time the SCR will switch to a non-conducting state (about three secondsafter interruption of power). Increasing the capacitance of CT1 will increase the period of this time delay.

When SCR becomes non-conducting the light emitting diode of MOC 3010 ceases to emit light upon the silicon bilateral switch. The silicon bilateral switch becomes non-conductive, hence the resulting absence of gate current to the triac results in the triac becoming nonconductive. This makes the clock motor inoperative.

Resumption of power within the time delay will result in the clock motor operating since the light emitting diode of MOC 3010 will emit light during the time delay period.

If power is resumed after the time delay period, then SCR will be non-conducting until a signal pulse is received at its gate (5).

With SCR being non-conducting the light emitting diode of MOC 3010 fails to emit light and consequently, the triac stays non-conductive since the light activated silicon bilateral switch of NOC 3010 remains non-conductive.

When SCR is non-conductive a very small current flows from (7) through the light emitting diode of MOC 3010, (insufficient to cause the led to emit light) resistor R4, diode D4, resistor R12, and the base of transistor T1. Transistor T1 then becomes conductive and allows current to flow to integrated circuit Ua 2240C thus making the integrated circuit operative.

Integrated circuit Ua 2240C and its associated components R8, R9, R10, R11, RT2, C2, CT2 comprise a precision 24 hour timer which sends a pulse from its terminal 8 at the end of its timing cycle.

The precision timer is the combination of a local oscillator and an eight bit counter. The local oscillator frequency divided by $2^8$, or 256, yields the output frequency. The variable resistor of RT2 adjusts the local oscillator frequency so that an exact 24 hour period can be obtained.

At the end of the precision timer period a pulse is sent from terminal 8 of the Ua 2240C through resistor R7 and didode D5 to the gate of the SCR. If a voltage difference exists from (4) to (8) at the SCR then the SCR conducts thus resulting in the energization of the clock motor as described previously.

If no voltage exists at the SCR anode and cathode terminals, then power has not been restored and the precision timer will continue to run sending a second pulse to the SCR 24 hrs. after the first pulse.

Resistor R7 is a current limiting resistor that prevents overload of the SCR gate. Diode D5 is a zener diode which blocks current flow from terminal 8 of the Ua 2240C to (5) of the SCR gate during normal conditions. When a pulse is sent from terminal 8 of the Ua 2240C, its voltage is sufficient in magnitude to overcome (exceed) the zener voltage thus allowing the pulse to travel to (5) of the SCR gate.

CT2 is the timing capacitor of the local oscillator of Ua 2240C.

R9 & R10 constitute a voltage divider which provides sufficient voltage at the "reset" terminal of Ua 2240C to initiate local oscillator action.

R11 provides voltage from the Ua 2240C internal regulator to the time base oscillator output.

R8 provides voltage to the binary counter output stage at terminal 8 of Ua 2240C.

R13 insures the base of T1 is at emitter potential during normal operation.

R12 limits current flow so as to not exceed the maximum allowable base current of T1.

Switch S1 is a momentary "on" push button switch to set the circuit to normal operation (precision timer de-energized) when installing the time clock or as needed. Switch S1 sends a positive pulse through resistor R14, overcoming the zener voltage of diode D5 to the gate of SCR. SCR then becomes conductive which then places the circuit in the "normal" condition as described previously. R14 limits current flow so as to not overload the SCR gate at (5).

I claim:

1. An automatic electric time delay switch assembly for maintaining a time switch clock synchronized with real time in the event of an electric power failure which comprises:

(a) an electric circuit including a power source, (b) a time switch clock in the electric circuit, (c) first electronic time delay means in the electric circuit operative to measure a first predetermined period of time after the occurrence of a power failure, (d) electric relay means in the electric circuit operative in the open condition to disconnect the clock from the power source if the power failure remains at the conclusion of the said first predetermined time period, and (e) second electronic time delay means in the electric circuit operative upon disconnection of the clock from the power source to maintain the relay means in its open condition for a second predetermined period of time which corresponds to a complete cycle of the clock, (f) the second electronic time delay means being further operative to re-connect the clock to the power source in synchronization with real time at the conclusion of the second predetermined period of time, if during that period power has been restored to the circuit.

* * * * *

UNITED STATES PATENT AND TRADEMARK OFFICE

CERTIFICATE OF CORRECTION

PATENT NO. : 4,602,165

DATED : July 22, 1986

INVENTOR(S) : Richard W. Rosenberg

It is certified that error appears in the above-identified patent and that said Letters Patent are hereby corrected as shown below:

Column 6, line 32 (claim 1) cancel "relay" and substitute --switch--;

Column 6, line 39, (claim 1) cancel "relay" and substitute --electric switch--.

Signed and Sealed this

Seventh Day of October, 1986

[SEAL]

*Attest:*

DONALD J. QUIGG

*Attesting Officer*

*Commissioner of Patents and Trademarks*